United States Patent [19]

Tegg

[11] Patent Number: 4,775,109

[45] Date of Patent: Oct. 4, 1988

[54] TOILET PAPER HOLDER

[75] Inventor: Duane T. Tegg, Brooklyn Center, Minn.

[73] Assignee: Satellite Industries, Inc., Minneapolis, Minn.

[21] Appl. No.: 63,828

[22] Filed: Jun. 19, 1987

[51] Int. Cl.[4] ..... B65H 19/00; B65D 85/66

[52] U.S. Cl. ..... 242/55.3; 242/55.53; 206/391; 206/409

[58] Field of Search ..... 242/55.2, 55.3, 55.53; 312/39–41; 206/389, 391, 409

[56] References Cited

U.S. PATENT DOCUMENTS 2,550,209 4/1951 Tuttle ..... 312/39 X 3,930,697 1/1976 Barouh et al. ..... 242/55.53 X

*Primary Examiner*—David Werner

*Attorney, Agent, or Firm*—Herman H. Bains

[57] ABSTRACT

A multi-compartmented toilet paper holder includes a mounting plate, which is attachable to a vertical wall. A housing pivotally engages the mounting plate to permit pivoting of the housing between open and closed positions. In one embodiment of the invention, an intermediate wall divides the interior of the housing into upper and lower compartments. In another embodiment of the invention, an intermediate wall divide the housing into side-by-side lateral compartments. Each compartment is of a size to accommodate a roll of toilet paper and each compartment has an access opening through which the paper is dispensed at the lower portion thereof.

5 Claims, 3 Drawing Sheets

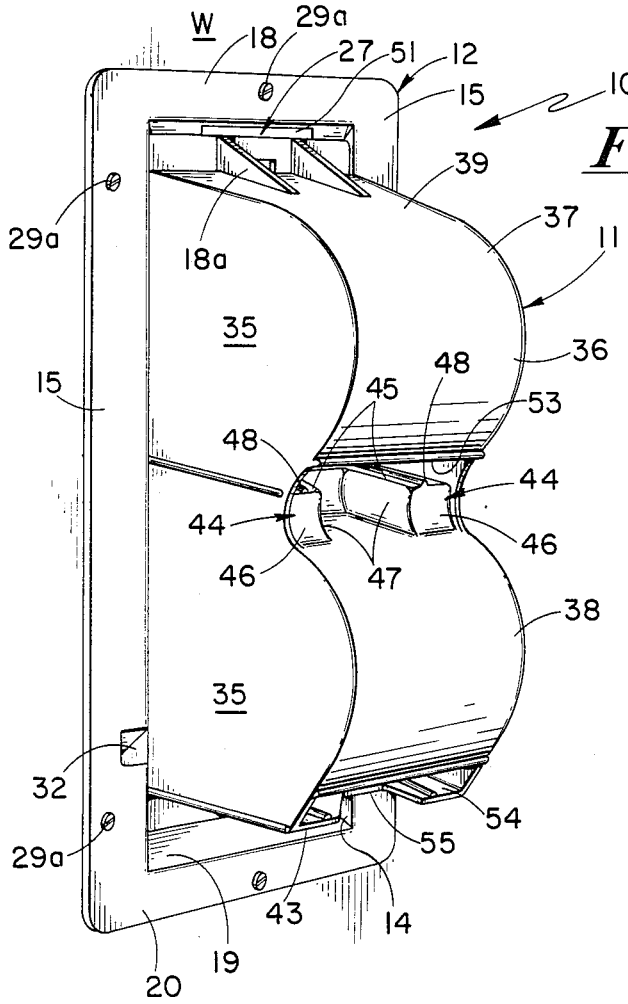
Fig.-1
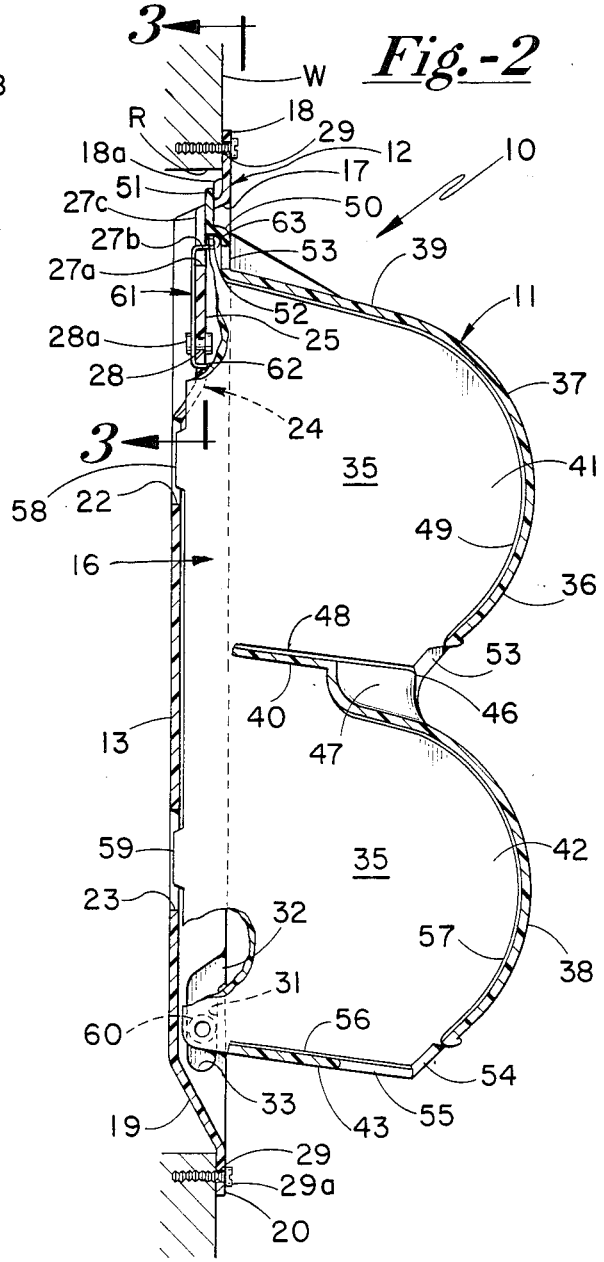
Fig.-2
Fig.-3
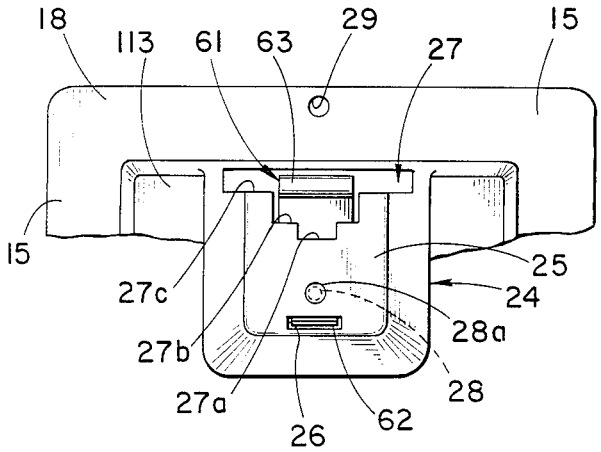

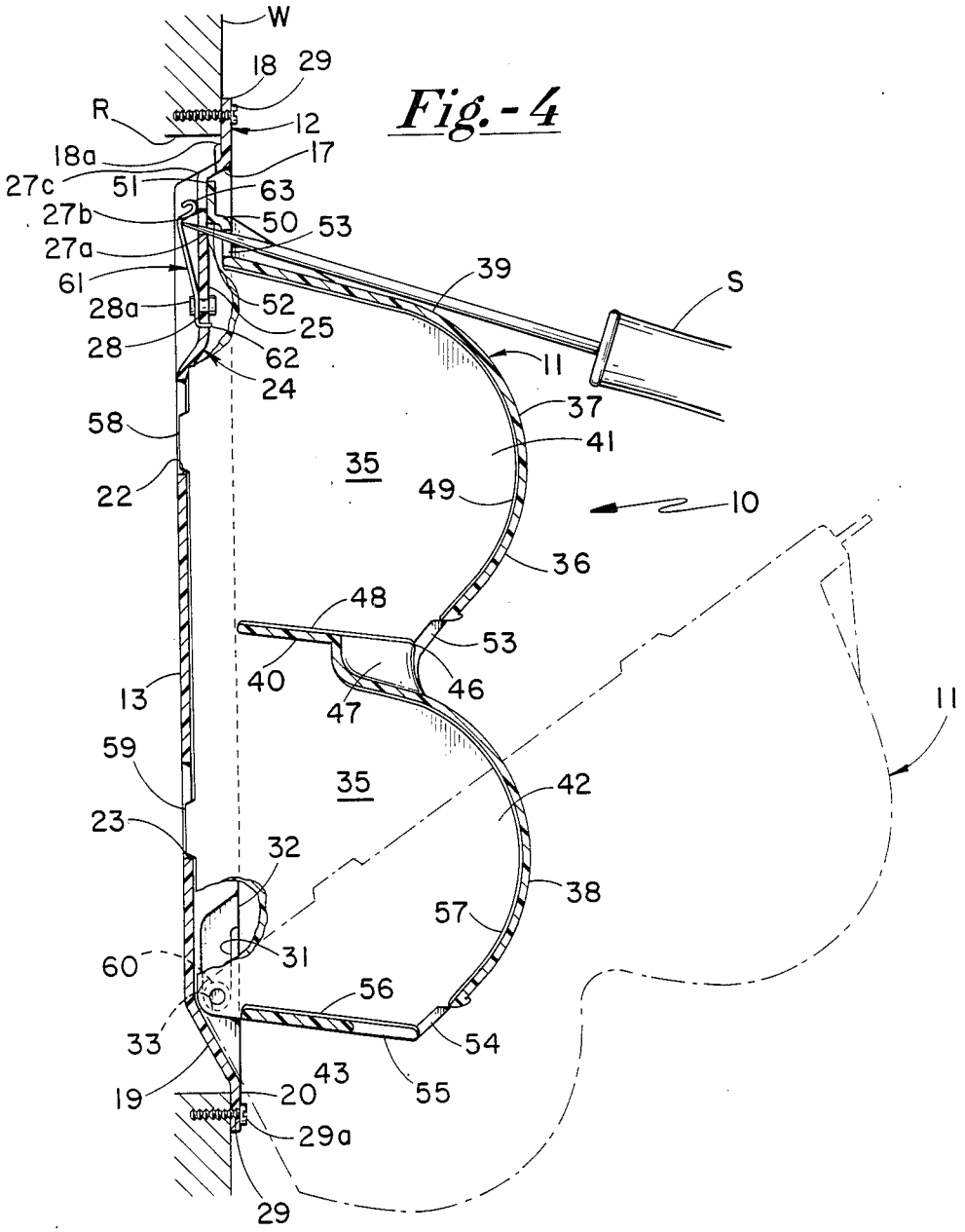
Fig.-4
Fig.-8
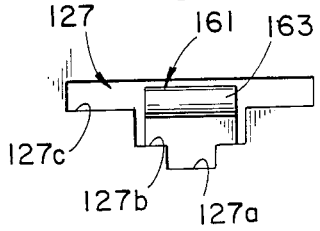

TOILET PAPER HOLDER

This invention relates to a toilet paper holder.

BACKGROUND OF THE INVENTION

Various types of commercial toilet paper holders have been developed and are used extensively in public toilets, as well as portable restrooms. The typical holder is usually comprised of a paper supporting spindle, which is mounted between a pair of brackets. Such holders are unsightly in appearance and are unprotected against dust, moisture, and the like. Further, such holders permit the entire roll to be readily removed by vandals, especially from portable restrooms.

Some attempts have been made to enclose the paper roll in a housing, but many of these prior art devices also employ a spindle arrangement. Other enclosed type toilet paper holders are difficult to manipulate in unwinding the paper. For example, U.S. Pat. No. 2,422,749 discloses a paper holder, which includes a housing, but the paper roll is supported by a spindle. U.S. Pat. No. 2,668,022 discloses an enclosed holder, which uses a spindle to support the paper roll. U.S. Pat. No. 4,467,974 discloses an enclosed paper holder having no spindle, but this paper holder dispenses the paper upwardly through a tensioning mechanism.

SUMMARY OF THE INVENTION

It is an object of this invention to provide a toilet paper holder, of simple and inexpensive construction, in which paper may be readily unwound from a paper roll positioned within a locked enclosure.

Another object of this invention is provide a novel and improved multi-compartmented paper holder having no spindles, and in which the paper is dispensed through a dispensing opening located at the lower portion of each compartment.

A further object of this invention is to provide a multi-compartmented toilet paper holder, which is releasably locked in a closed position, but which may be readily unlocked and shifted to an open position for servicing or the like.

FIGURES OF THE DRAWING

FIG. 1 is a perspective view of one embodiment of the novel toilet paper holder;

FIG. 2 is a cross-sectional view of the toilet paper holder shown in FIG. 1;

FIG. 3 is a cross-sectional view taken approximately along the line 3—3 of FIG. 2 and looking in the direction of the arrows;

FIG. 4 is a cross-sectional view similar to FIG. 2, illustrating how the housing is unlocked, and illustrating the housing in an open condition by dotted line configuration;

FIG. 8 is a fragmentary elevational view of the locking means employed in the embodiment of FIGS. 5–7.

DESCRIPTION OF THE PREFERRED EMBODIMENT

Figure 5:
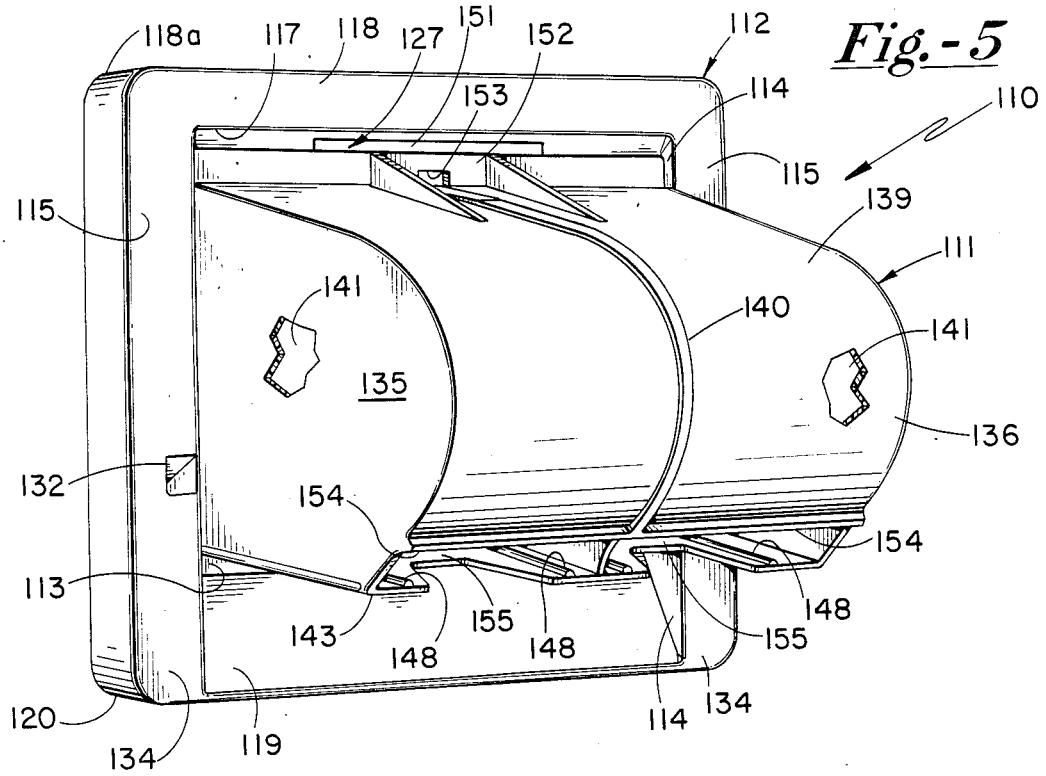
FIG. 5 is a perspective view of a different embodiment of the novel toilet paper holder.

Referring now to the drawings and, more specifically, to FIGS. 1–4, it will be seen that one embodiment of the novel toilet paper holder, designated generally by the reference numeral 10, is thereshown. The toilet paper holder 10 is preferably formed of plastic, such as a high density polyethylene, in a molding operation. The toilet paper holder 10 includes a multi-compartmented housing 11, which is secured to a mounting plate or back plate 12.

It will be noted that the back plate 12 is of generally rectangular configuration and includes a generally flat central portion 13, which is offset adjacent its longitudinal margin by offset portions 16, and is offset along its upper transverse margin by an offset portion 17. The central portion 13 is also offset along its lower transverse margin by an offset lower end portion 19, as best seen in FIG. 2. These offset portions terminate in outturned longitudinal flanges 15, an outturned upper flange 18, and an outturned lower flange 20, which are continuous, and which are disposed substantially parallel to the general plane of the flat central portion.

It will further be noted that the upper flange 18 of the back plate is provided with reinforcing fillets 21 to impart strength thereto. The flat central portion has a pair of laterally spaced apart upper slots 22 therein and a pair of laterally spaced apart lower slots 23 therein. These slots are located adjacent the longitudinal margins of the flat central portion, and it will be noted that the slots forming the upper and lower pairs, respectively, are transversely aligned.

The back plate 12 is also provided with an upper embossment 24, which includes a central portion 25 disposed in substantial parallel relation with the flat central portion 13. The flat central portion 25 has an elongate transverse slot 26 therein adjacent the lower portion thereof. The central portion 25 also has an opening 27 therein, which includes a generally rectangular-shaped lower portion **27*a*, a rectangular-shaped intermediate portion 27*b*, and a rectangular-shaped upper portion 27*c*. It will be seen that the various portions of the opening 11 are symmetrically arranged with respect to each other and that the upper portion 27*c* thereof extends beyond the central portion 25 of the embossment 24**.

The central portion 25 of the embossment is provided with an aperture 28 therein, and it will also be noted that the flanges 15, 18, and 20 are provided with apertures **29*a* therein. The apertures 29** accommodate bolts, screws, or the like for securing the back plate to a vertical wall surface W of a restroom, such as a portable restroom. In this regard, the wall W of the portable restroom will be provided with a recess R, which receives the central portion of the back plate, the flanges of the back plate engaging the surface of the wall W.

The back plate 12 is also provided with a pair of guide elements 30 adjacent the lower portion thereof. The guide elements 30 are located laterally of the central portion 13 and are integral with the flanges 15 and the offset portions 14. The guide elements 30 define vertical guideways 31, each having an opening 32 therein in the adjacent flange 15. Each guide element has an arcuate lower surface 33, and a flat panel portion 34 extends between and is rigidly connected to the arcuate lower surface 33 and extends downwardly therefrom, as best seen in FIG. 2. The panel portion 34 is integrally joined with the lower flange 20 and is disposed in substantially coplanar relation therewith.

The multi-compartmented housing 11 of the toilet paper holder includes a pair of substantially flat vertically disposed side walls 35. A multi-curved front wall 36 is integral with the side walls 35 and includes a curved upper front wall portion 37 and a curved lower front wall portion 38. It will be seen that the upper front wall portion 37 merges upwardly and is continuous with a top wall 39. It will further be noted that the housing 11 is provided with an intermediate wall 40, which serves to separate the interior of the housing 11 into an upper compartment 41 and a lower compartment 42.

The lower compartment 42 is provided with a lower wall 43, which is disposed substantially parallel to the intermediate wall 40. Referring again to FIG. 1, it will be seen that the housing 11 is provided with a pair of laterally spaced apart embossments 44 intermediate the ends of the housing and each including an upper surface 45, a front surface 46, and a side surface 47. It will be noted that the upper surface 45 of each embossment 44 is disposed substantially coplanar with the upper surface of the intermediate wall 40. The front surface 46 of each embossment is continuous with the lower front wall portion 38, and the spacing between the side wall portions 47 defines a recess 47*a*.

It will be noted that the intermediate wall 40 is provided with laterally spaced apart ribs 48, which extend in a fore and aft direction. The ribs 48 extend forwardly from the intermediate wall along the upper surface 45 of each embossment 44. The inner surface of the upper front wall portion and top wall 39 is also provided with a pair of laterally spaced apart ribs 49. It will also be noted that the top wall 39 of the upper compartment terminates upwardly in an upturned portion 50, which is integral with an upwardly projecting tab 51. The juncture between the upturned portion 50 and the tab 51 is of arcuate configuration and defines a shoulder 52, as best seen in FIG. 2. The upturned portion 50 has a centrally located opening 53 therein.

It will be noted that the upper compartment 41 has an opening defined between the upper front wall portion 37 and the intermediate wall 40. The opening 53 communicates with the recess 47*a* between the embossments 44. The lower compartment 42 communicates with the exterior through an opening 54, which is defined in part by a recess 55 in the lower wall 43.

It will also be noted that the lower wall 43 has laterally spaced apart fore and aft extending ribs 56 integral with the upper surface thereof. The inner surface of the lower front wall portion 38 is also provided with a pair of laterally spaced apart ribs 57. It will be appreciated hat each of the compartments 41 and 42 is adapted to contain a roll of toilet paper, and the ribs on the front wall, the intermediate wall, or the lower wall permit ready unrolling of the roll paper and also prevent bridging of the paper.

Referring again to FIG. 2, it will be seen that the side walls 35 each have an upper tab 58 and a lower tab 59 affixed thereto and projecting rearwardly therefrom. The lower rear portion of each side wall is provided with a guide and pivot element 60, which is integral there with and which projects laterally outwardly therefrom. The tabs 58, 59 are adapted to be inserted in the slots 22, 23 of the back plate, and the guide and pivot elements 60 are adapted to be positioned within the guideways 31.

It is pointed out that the housing 11 is shiftable between a closed position, as illustrated in FIG. 1, and an open position, as illustrated in the phantom line configuration of FIG. 4. When the housing is in the open condition, it extends outwardly and upwardly from the back plate to permit servicing or the provision of paper rolls when the rolls contained within the housing have been used up. When the housing is in the closed condition, it is releasably locked to the back plate 12.

In this regard, the back plate 12 is provided with a substantially flat spring lock 61, which is positioned rearwardly of the central portion 25 of the embossment 24. A bolt extends through the opening 28 and secures the lock 61 to the rear surface of the central portion of the upper embossment 24. It will be noted that the spring lock 61 is of substantially rectangular configuration and has an inturned tab 63 at its lower end, which projects through the slot 26 in the embossment 24. The upper end portion of the lock 61 is shaped to define a U-shaped spring element 63, which projects through the portion 27*b* of the opening 27. It will be seen that, when the housing is in the locked condition, the tab 51 projects through the upper portion 27*c* of the opening 27 and rearwardly of the flange 18 of the back plate.

In use, the toilet paper holder will be mounted on the vertical wall W of a restroom, and preferably a portable restroom. The pivot element 60 will be positioned within the vertical guideways 31 defined by the guide elements 30 on the back plate 12. When the housing 11 is in the open condition, it will be seen that it extends outwardly and upwardly from the base plate and the pivot elements 60 will be positioned in the arcuate lower surfaces 33 of the vertical guideways 31. The rolls of paper to be dispensed will be positioned in the upper compartment 41 and the lower compartment 42 and the rolls will be partially unwound so that the paper extends outwardly through the openings 53 and 54 of each compartment.

Thereafter, the housing 11 is pivoted to the closed position so that the tabs 58, 59 project into the slots 22, 23 in the back plate. In this position, the tab 51 will project through the portion 27*c* of the opening 27 upwardly behind the flange 18 on the back plate. The shoulder 52 will engage and overlie the U-shaped spring element 63 of the spring lock 61. The housing will, therefore, be locked in the closed position, and it will be noted that the pivot elements 60 will be spaced intermediate the ends of the guideways 31.

When paper is to be dispensed, the user will insert his hand through the opening 53 or 54 and through the recess 47*a* or the recess 55. The roll of paper will be positioned upon the ribs and the user may easily manipulate the roll to unwind the predetermined length of paper therefrom. As pointed out above, the ribs within the compartments space the roll from the inner surfaces of the compartments and thereby prevent a bridging effect from occurring.

When it is desirable to replenish the paper rolls in the housing, an operator will insert a screw driver through the opening 53 in the housing and will depress the spring element 63 of the spring lock 61, as best seen in FIG. 4. The housing will be elevated slightly and then be allowed to move downwardly so that the pivot elements 60 will engage the lower arcuate surfaces of the vertical guideways 61. The housing will again swing open to the open position and will be limited in pivoting movement by the inter-engagement of the lower portion of the housing with the back plate. New paper rolls may be placed in the compartments, and the housing may then be shifted to the closed position.

Figure 6:
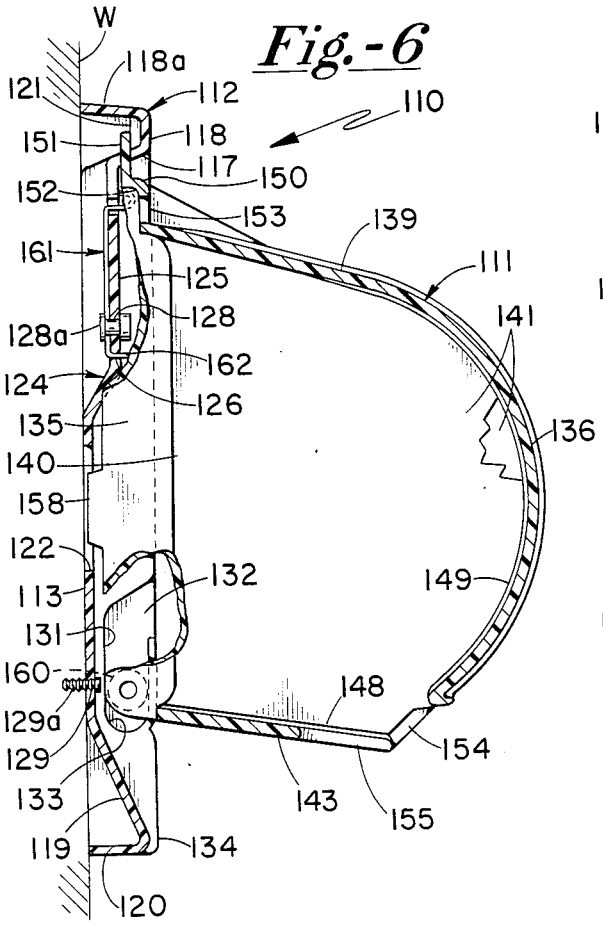
FIG. 6 is a cross-sectional view of the toilet paper holder illustrated in FIG. 5.
Figure 7:
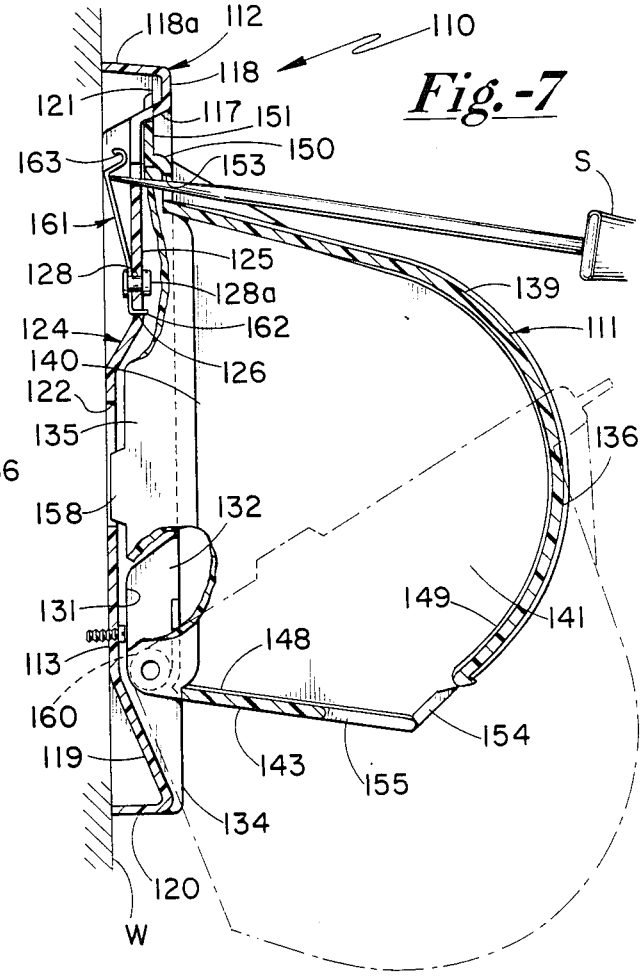
FIG. 7 is a cross-sectional view similar to FIG. 6 and illustrating the unlocking technique similar to that shown in FIG. 4.

Referring now to FIGS. 5, 6, and 7, it will be seen that a second embodiment of the novel toilet paper holder, designated generally by the reference numeral 110, is thereshown. It is again pointed out that the toilet paper holder 110 is also preferably molded from a rigid plastic material, such as high density polyethylene, although other materials may also be used. The toilet paper holder 110 includes a multi-compartmented housing 111, which is pivotally mounted on a back plate 112.

The back plate 112 is also of generally rectangular-shaped configuration and includes a flat central portion 113. The vertical or longitudinal marginal portions of the flat central portion are offset, as at 114, and these offset portions are integral with an intermediate portion 115, which is disposed in substantial parallel relation with the flat central portion 113. The intermediate portion 115 terminates in an inturned flange 115*a*.

The upper transverse marginal portion of the flat central portion 113 is provided with an offset portion 117, which is integral with an intermediate portion 118 that terminates in an inturned or rearwardly extending flange 118*a*. The lower transverse margin of the flat central portion is integral with an offset portion 119, which terminates in an inturned or rearwardly projecting flange 120, as best seen in FIG. 5. Reinforcing fillets 121 are integral with the offset upper end portion 117, the intermediate portion 118, and the inturned flange 119*a* to impart rigidity thereto. It will also be noted that the central portion 113 is provided with a pair of longitudinally extending substantially parallel elongate slots 122 therein adjacent the offset portions 114 thereof.

The back plate 112 is also provided with an upper embossment 124, which includes a flat central portion 125. The flat central portion 125 has a transverse slot 126 therein and an opening 127 therein. It will be noted that the opening 127 is similar in configuration to the opening 27 in the embodiment of FIGS. 1–4. In this respect, the opening 127 includes a lower rectangular portion 127*a*, an intermediate rectangular portion 127*b*, and an upper rectangular portion 127*c*.

The embossment 124 is provided with a centrally located aperture 128 positioned above the slot 126 and below the portion 113 of the back plate is provided with a plurality of apertures 129, which accommodate bolts, screws, or the like for attaching the back plate to a vertical wall.

The back plate 112 is also provided with a pair of laterally spaced apart guide elements 130, which are similar in construction to the guide elements of the embodiment of FIGS. 1–4, and each defining vertical guideways 131 having an opening 132 in the intermediate portion 115. Each guide element 130 has an arcuate lower surface 133, and it will be seen that a flat panel portion 134 is integral with and extends between the guide elements 130 and is secured to the upturned flange 120.

The housing 111 also includes substantially flat vertical side walls 135, which are integral with a curved front wall 136. The front wall 136 is continuous with a top wall 139. The housing 111 is provided with a vertically disposed intermediate wall 140, which is disposed between and substantially parallel to the side walls 135. It will, therefore, be seen that the interior of the housing 111 defines a pair of substantially identical lateral compartments 141.

The housing 111 is also provided with a lower wall 143, which extends between and is integral with the side walls 135. The lower wall portion for each compartment 141 is provided with a pair of laterally spaced apart ribs 148, which project upwardly from the upper surface of the lower wall, as best seen in FIG. 2. Similarly, the interior surface of the front wall portion for each compartment 141 is also provided with an arcuate rib 149. It will be noted that each rib 148 is disposed in substantially the same vertical plane as one of the arcuate ribs 149 in the manner of the embodiment of FIGS. 1–4. The ribs 148, 149 function in the same manner as the ribs of the previously described ribs 48, 49 and thereby prevent bridging of the paper roll within the compartments 141.

It will be seen that top wall 139 of the housing 111 has an upturned portion 150 integrally formed with the upper end thereof, and this upturned portion terminates in an upwardly projecting tab 151. The juncture between the upturned portion and tab 151 includes an arcuate connector portion, which defines a downwardly facing shoulder 152. The offset portion 150 has a centrally located aperture 153 therein.

It will also be noted that each of the side walls 135 is provided with a rearwardly projecting tab 158. It will further be noted that each side wall 135 has a guide and pivot element 160 integrally formed therewith and projecting outwardly therefrom adjacent the lower rear corner portion thereof. The pivot elements 160 are adapted to be positioned within the vertical guideways 131, and tabs 158 are insertable into the slots 122 in the back plate when the housing is in the closed position.

It will be noted that each compartment 141 is provided with an access opening 154, which is defined between the lower edge of the front wall and the bottom wall 143. It will further be noted that the bottom wall 143 has a recess 155 therein, which communciates with the access opening 154 in the manner of the embodiment of FIGS. 1–4. This arrangement permits easy manipulation of the paper roll within the housing by a user.

It is pointed out that the housing 111 is shiftable between a closed position, as illustrated in full line configuration of FIG. 7, and an open position, as illustrated in phantom line configuration of FIG. 7. Means are provided for releasably locking the housing to the back plate and this means also includes a spring lock 161, which is of generally rectangular configuration, and which is provided with an outturned tab 162 at its lower end. The spring lock 161 is also provided with a U-shaped spring element 163 at its upper end.

It will, therefore, be seen that the spring lock 161 is substantially identical to the spring lock 61 of the embodiment of FIGS. 1–4. The spring lock is positioned behind and against the central portion 125 of the upper embossment 124, and is secured thereto by a suitable bolt, which passes through the opening 128. The inturned tab 162 projects through the slot 126, while the U-shaped spring element projects through the portion 127*b* of the opening 127.

Referring now to FIG. 7, it will be seen that, when the housing 111 is in the closed or locked position, the spring lock coacts with the housing 111 in substantially the same manner as the spring lock 61 of the previous described embodiment. The spring lock may be released by a user using a screw driver or similar tool to depress the spring lock to thereby permit the housing to be raised and then swung to the open position. It will be appreciated that the housing 111, as well as the housing 11, may be completely removed from the back plate by simply removing the pivot elements from the guideways of the associated back plate.

From the foregoing description, it will be seen that I have provided a novel toilet paper holder, which is especially adaptable for portable restrooms and the like, and which completely encloses the paper rolls to thereby minimize theft or vandalism of. It will also be noted that the novel toilet paper holder is provided with a unique locking arrangement, which is generally inaccessible to vandals, but which may be easily manipulated by service personnel to permit ready shifting of the housing to the open condition for servicing.

Thus, it will be seen that we have provided a novel toilet paper holder, which is not only of simple and inexpensive construction, but one which functions in a more efficient manner than any heretofore comparable structure.

What is claimed is:

1. A multi-compartmented toilet paper holder comprising:

a generally rectangular shaped flat mounting back plate, means for securing said mounting plate to a vertical surface, said back plate having upper and lower portions, a multi-compartmented housing including substantially flat side walls, a curved front wall, a horizontally disposed intermediate wall integral with said side walls and with said front wall and extending rearwardly therefrom to divide the interior of said housing into upper and lower compartments, said side side walls having upper and lower portions, said front and intermediate walls each having inner surfaces, means defining a lower wall for said lowermost compartment, said lower wall having an upper surface, each compartment being of a size to contain a roll of toilet paper therein, each compartment having a forwardly facing access opening therein adjacent the lower portion thereof through which the toilet paper may be unrolled, a pair of substantially vertically disposed guideways in said mounting plate adjacent opposite edge portions thereof, guide elements on the lower portions of said side walls of said housing projecting outwardly therefrom and engaging said guideways, and coacting therewith to permit shifting of the housing between open and closed positions, said housing, when in the closed position, being disposed against said mounting plate, and, when in the open position, extending outwardly and upwardly from the lower portion of said back plate, said housing being vertically translatable and pivotal relative to said mounting plate when shifted between open and closed positions, and a releasable lock element on the upper portion of said back plate, a lock engaging element on said housing releasably engaging said locking element for releasably locking the housing in the closed position.

2. The multi-compartmented toilet paper holder as defined in claim 1 wherein said mounting plate has a pair of elongate slots therein, each being located adjacent one vertical longitudinal edge portion of the mounting plate, each of said side walls of said housing having substantially straight rear vertical edges, and each side wall having a tab projecting rearwardly from the vertical edge portion thereof engageable with one of said slots when said housing is in the closed position.

3. The multi-compartmented toilet paper holder as defined in claim 1 wherein each of said vertical guideways in said mounting plate has a lower wall portion for limiting downward movement of the housing, said guide elements on said housing being spaced above the lower wall elements of said guideways when said housing is in the closed condition.

4. The multi-compartmented toilet paper holder as defined in claim 1 wherein the inner surface of said front wall, the inner surface of said intermediate wall, and the upper surface of said lower wall means each has a plurality of rib means thereon for engagement by each roll of toilet paper positioned within said compartments.

5. The multi-compartmented toilet paper holder as defined in claim 1 wherein said lock engaging element on said housing is on said upper wall of the uppermost compartment of said housing.

* * * * *